US012522898B2

(12) United States Patent
Fujiyoshi et al.

(10) Patent No.: US 12,522,898 B2
(45) Date of Patent: Jan. 13, 2026

(54) METHOD FOR MANUFACTURING Fe—Co-BASED ALLOY BAR, AND Fe—Co-BASED ALLOY BAR

(71) Applicant: Proterial, Ltd., Tokyo (JP)

(72) Inventors: Masaru Fujiyoshi, Tokyo (JP); Shujiroh Uesaka, Tokyo (JP); Kouji Kobayashi, Tokyo (JP)

(73) Assignee: Proterial, Ltd., Tokyo (JP)

( * ) Notice: Subject to any disclaimer, the term of this patent is extended or adjusted under 35 U.S.C. 154(b) by 430 days.

(21) Appl. No.: 17/909,438

(22) PCT Filed: Mar. 10, 2021

(86) PCT No.: PCT/JP2021/009570
§ 371 (c)(1),
(2) Date: Sep. 6, 2022

(87) PCT Pub. No.: WO2021/182518
PCT Pub. Date: Sep. 16, 2021

(65) Prior Publication Data

US 2023/0349028 A1 Nov. 2, 2023

(30) Foreign Application Priority Data

Mar. 10, 2020 (JP) ..... 2020-040832

(51) Int. Cl.

| | |
|---|---|
| ***C21D 8/12*** | (2006.01) |
| ***C22C 19/07*** | (2006.01) |
| ***C22C 30/00*** | (2006.01) |
| ***C22C 38/00*** | (2006.01) |
| ***C22C 38/10*** | (2006.01) |

(52) U.S. Cl.
CPC ..... *C22C 30/00* (2013.01); *C21D 8/1222* (2013.01); *C21D 8/125* (2013.01); *C22C 19/07* (2013.01); *C22C 38/00* (2013.01); *C22C 38/10* (2013.01); *C21D 2201/05* (2013.01); *C22C 2202/02* (2013.01)

(58) Field of Classification Search
CPC ..... C22C 38/10; C21D 8/125
See application file for complete search history.

(56) References Cited

U.S. PATENT DOCUMENTS

| | | | | |
|---|---|---|---|---|
| 5,919,319 | A * | 7/1999 | Couderchon | C22C 38/10 148/309 |
| 6,153,020 | A | 11/2000 | Chen et al. | |
| 7,128,790 | B2 | 10/2006 | Waeckerle et al. | |
| 2008/0099106 | A1 | 5/2008 | Pieper et al. | |
| 2009/0184790 | A1 | 7/2009 | Pieper et al. | |
| 2014/0338793 | A1 | 11/2014 | Leary et al. | |
| 2018/0119241 | A1 | 5/2018 | Susan et al. | |

FOREIGN PATENT DOCUMENTS

| | | |
|---|---|---|
| CN | 1596321 | 3/2005 |
| CN | 102296238 | 12/2011 |
| CN | 102296238 A * | 12/2011 |
| CN | 103691741 | 4/2014 |
| CN | 104708005 | 6/2015 |
| CN | 108130493 | 6/2018 |
| CN | 115279926 | 11/2022 |
| GB | 896881 | 5/1962 |
| GB | 1415552 | 11/1975 |
| JP | S5224915 | 2/1977 |
| JP | S61130419 | 6/1986 |
| JP | H05195170 | 8/1993 |
| JP | H05279784 | 10/1993 |
| JP | H05304014 | 11/1993 |
| JP | H07166239 | 6/1995 |
| JP | H08300044 | 11/1996 |
| JP | 2002194475 | 7/2002 |
| JP | 2004515644 | 5/2004 |
| JP | 2004277842 X | 10/2004 |
| JP | 2006336038 | 12/2006 |
| JP | 2020025077 | 2/2020 |
| KR | 20020095108 | 12/2002 |
| WO | 2019059256 | 3/2019 |
| WO | 2021182518 | 9/2021 |

OTHER PUBLICATIONS

Kamali, Mohammad R., et al. "Reobservations of ferrite recrystallization in a cold-rolled ordered Fe-50Co-10V alloy using the EBSD method." Materials Characterization 158 (2019): 109962. (Year: 2019).*

English machine translation of CN 102296238 A (Year: 2011).*

Sakr, Mohamed, and Shuli Liu. "A comprehensive review on applications of ohmic heating (OH)." Renewable and Sustainable Energy Reviews 39 (2014): 262-269. (Year: 2014).*

Raulf, M., Persson, K. (2014). Rolling of Steel. In: Mang, T. (eds) Encyclopedia of Lubricants and Lubrication. Springer, Berlin, Heidelberg. (Year: 2014).*

"International Search Report (Form PCT/ISA/210) of PCT/JP2021/009570", mailed on May 25, 2021, with English translation thereof, pp. 1-6.

Shihao Li et al., "3D printing of ductile equiatomic Fe—Co alloy for soft magnetic applications", Additive Manufacturing, Sep. 10, 2021, pp. 1-9, vol. 47.

(Continued)

*Primary Examiner* — Jophy S. Koshy
*Assistant Examiner* — Joshua S Carpenter
(74) *Attorney, Agent, or Firm* — JCIPRNET

(57) ABSTRACT

An Fe—Co-based alloy bar and a method for manufacturing same, whereby excellent magnetic properties can be reliably obtained. The method for manufacturing an Fe—Co-based alloy bar comprises a heating straightening step for applying tensile stress to a hot-rolled material of an Fe—Co-based alloy while heating the hot-rolled material to a temperature of 500-900° C. Preferably, ohmic heating is used in the heating straightening step. In addition, the Fe—Co-based alloy bar has 20% or more by area ratio of crystal grains having a grain orientation spread (GOS) value of at least 0.5°.

8 Claims, No Drawings

(56) References Cited

OTHER PUBLICATIONS

Shihao Li et al., "3D printing of ductile equiatomic Fe—Co alloy for soft magnetic applications", Additive Manufacturing, Nov. 1, 2021, pp. 1-12, vol. 47.
Mohammad R. Kamali et al., "Reobservations of ferrite recrystallization in a cold-rolled ordered Fe-50Co-10V alloy using the EBSD method", Materials Characterization, Oct. 23, 2019, pp. 1-13, vol. 158.
Wu; Lai-Zhi et al., "Microstructures of ultra-fine grained FeCoV alloys processed by ECAP plus cold rolling and their evolutions during tempering", Transactions of Nonferrous Metals Society of China, Apr. 2010, pp. 602-606, vol. 20, Issue 4.
L.C. Zhang et al., "Deformation-induced grain refinement in body-centered cubic Co—Fe alloys upon room temperature compression", Materials Science and Engineering: A, Aug. 20, 2010, pp. 5796-5800, vol. 527, Issues 21-22.
D.F. Susan et al., "The Effects of Annealing After Equal Channel Angular Extrusion (ECAE) on Mechanical and Magnetic Properties of 49Fe—49Co—2V Alloy", Metallurgical and Materials Transactions A, Jul. 9, 2021, pp. 4090-4099, vol. 52.
Brahim Nabi et al., "Effect of long range order on mechanical properties of partially recrystallized Fe49Co—2V alloy", Materials Science and Engineering: A, Jan. 13, 2014, pp. 70-76, vol. 592.
"Search Report of Europe Related Application, Application No. 21957462.1", issued on Oct. 8, 2024, p. 1-p. 11.
"Search Report of Europe Related Application, Application No. 21957463.9", issued on Oct. 8, 2024, p. 1-p. 13.
Office Action of China Counterpart Application, with English translation thereof, issued on Mar. 12, 2024, pp. 1-11.
"Office Action of China Related Application No. 202180075819.2", issued on Nov. 23, 2024, with English translation thereof, pp. 1-10.
"Office Action of China Related Application No. 202180075803.1", issued on Nov. 12, 2024, with English translation thereof, pp. 1-12.
"International Search Report (Form PCT/ISA/210) of PCT/JP2021/033818," mailed on Nov. 30, 2021, with English translation thereof, pp. 1-6.
"International Search Report (Form PCT/ISA/210) of PCT/JP2021/033819," mailed on Nov. 30, 2021, with English translation thereof, pp. 1-6.
"Office Action of U.S. Related Application, U.S. Appl. No. 18/037,075", issued on Feb. 13, 2025, p. 1-p. 29.
"Office Action of U.S. Co-penging Application, U.S. Appl. No. 18/037,073", issued on Feb. 13, 2025, p. 1-p. 29.
"Office Action of U.S. Related Application, U.S. Appl. No. 18/037,073", issued on Jul. 22, 2025, p. 1-p. 23.
"Office Action of U.S. Related Application, U.S. Appl. No. 18/037,075", issued on Jul. 22, 2025, p. 1-p. 24.

* cited by examiner

METHOD FOR MANUFACTURING Fe—Co-BASED ALLOY BAR, AND Fe—Co-BASED ALLOY BAR

CROSS-REFERENCE TO RELATED APPLICATION

This application is a 371 application of the international PCT application serial no. PCT/JP2021/009570, filed on Mar. 10, 2021, which claims the priority benefit of Japan application no. 2020-040832, filed on Mar. 10, 2020. The entirety of each of the above-mentioned patent applications is hereby incorporated by reference herein and made a part of this specification.

TECHNICAL FIELD

The present invention relates to a method for manufacturing an Fe—Co-based alloy bar and an Fe—Co-based alloy bar.

BACKGROUND ART

Bars of an Fe—Co-based alloy represented by Permendur, which is known as an alloy having excellent magnetic properties, are used in various products such as sensors, cylindrical magnetic shields, solenoid valves, and magnetic cores. As a method for manufacturing an Fe—Co-based alloy bar, for example, Patent Literature 1 describes that an ingot is heated to 1,000° C. to 1,100° C. and then hot-processed into a billet of about φ90 mm, scratches on the surface and the like are removed with a lathe, heating is performed at 1,000° C. to 1,100° C., and then a hot-rolled material (bar) of about φ6 to φ9 mm is produced.

CITATION LIST

Patent Literature

[Patent Literature 1]
Japanese Patent Laid-Open No. H7-166239

SUMMARY OF INVENTION

Technical Problem

Along with higher performance of the above products, further improvement in magnetic properties is also required for materials. It is difficult to reliably obtain strong magnetic properties by a conventional manufacturing method as described in Patent Literature 1, and there is room for further studies.

Therefore, the present invention provides an Fe—Co-based alloy bar which enables excellent magnetic properties to be reliably obtained, and a method for manufacturing the same.

Solution to Problem

One aspect of the present invention is a method for manufacturing an Fe—Co-based alloy bar including a heating straightening step in which tensile stress is imparted to a hot-rolled material of an Fe—Co-based alloy while heating the temperature of the hot-rolled material to 500 to 900° C.

Preferably, the temperature of the hot-rolled material is 500 to 850° C.

Preferably, ohmic heating is used as a heating means in the heating straightening step.

Preferably, a solution treatment is performed before the heating straightening step.

Another aspect of the present invention is an Fe—Co-based alloy bar containing 20% or more of crystal grains having a grain orientation spread (GOS) value of 0.5° or more in terms of an area ratio.

Preferably, the average crystal grain size number is 6.0 or more and 9.5 or less.

Preferably, the average crystal grain size number is 6.0 or more and 8.5 or less.

Advantageous Effects of Invention

According to the present invention, it is possible to reliably obtain an Fe—Co-based alloy bar having excellent magnetic properties.

DESCRIPTION OF EMBODIMENTS

Hereinafter, an embodiment of the present invention will be described. First, a method for manufacturing an Fe—Co-based alloy bar of the present invention will be described. The Fe—Co-based alloy bar of the present invention is a straight bar-shaped bar having a circular (or elliptic) cross-sectional shape or a rectangular cross-sectional shape. Unless otherwise specified, the bar of the present embodiment is a round bar having a circular cross-sectional shape.

<Hot-Rolled Material Composition>

First, in the present embodiment, a hot-rolled material of an Fe—Co-based alloy is prepared. The Fe—Co-based alloy in the present invention refers to an alloy material containing 95% or more of Fe+Co in mass % and containing 25 to 60% of Co. Thereby, a high magnetic flux density can be exhibited.

Next, elements that may be contained in the Fe—Co-based alloy of the present invention will be described. In order to improve processability and magnetic properties, the Fe—Co-based alloy of the present invention may contain a total of one, two or more elements of V, Si, Mn, Al, Zr, B, Ni, Ta, Nb, W, Ti, Mo, and Cr in a maximum mass % of 5.0%. In addition, examples of impurity elements that are unavoidably incorporated include C, S, P, and O, and for example, the upper limit of each element is preferably 0.1%.

In the present embodiment, as an intermediate material of the Fe—Co-based alloy bar, a billet obtained from an Fe—Co-based alloy steel ingot having the above components is hot-rolled, and thereby a hot-rolled material can be obtained. Since an oxidized layer is formed by hot rolling in this intermediate material, for example, a polishing step in which the oxidized layer is mechanically or chemically removed may be introduced.

This hot-rolled material has, for example, a shape of a "hot-rolled bar" corresponding to an Fe—Co-based alloy bar. Thus, in consideration of processability in the post-step, the diameter may be 5 to 20 mm. Here, regarding bars other than round bars, the equivalent circle diameter of the horizontal cross section may be 5 to 20 mm.

<Solution Treatment Step>

In the present embodiment, a hot-rolled material before a heating straightening step to be described below may be subjected at least one solution treatment. This solution treatment is preferably performed so that effects of removing segregation of components of the hot-rolled material, improving magnetic properties, and improving processability can be expected. If the heating temperature during the solution treatment is too low, the processability tends to deteriorate, and if the heating temperature is too high, deterioration of magnetic properties is caused, and thus it is preferable to perform the treatment at a temperature of 800 to 1,050° C. The lower limit of the temperature is more preferably 850° C. The upper limit of the temperature is more preferably 950° C., and the upper limit of the temperature is still more preferably 900° C. In addition, the heating time can be set to 10 minutes to 60 minutes. In addition, in the solution treatment step, in order to solid-solutionize harmful precipitates without precipitating them, minimize regularization, and improve processability, a rapid cooling treatment is performed after heating. Here, even if the solution treatment step is omitted, the effects of the present invention can be obtained by adjusting the heating temperature in the heating straightening step to be described below.

<Heating Straightening Step>

In the present embodiment, a heating straightening step is performed in which tensile stress is imparted to the above hot-rolled material while heating is performed. In this case, if the hot-rolled material has a "bar" shape, it is pulled in the length direction of the hot-rolled bar, and thus the tensile stress is imparted. According to this step, it is possible to obtain a bar having very favorable magnetic properties and straightness while imparting residual strain to the hot-rolled material. The heating temperature in this case is set to 500 to 900° C. If the temperature is lower than 500° C., the processability decreases, and the bar may break when tensile stress is imparted. On the other hand, if the heating temperature exceeds 900° C., it is not possible to impart a preferable residual strain to the hot-rolled material. In the heating straightening step, the lower limit of the heating temperature is preferably 600° C., and more preferably 700° C. In addition, the upper limit of the heating temperature is preferably 850° C., more preferably 830° C., and still more preferably 800° C. Here, when the above solution treatment step is omitted, the lower limit of the heating temperature is preferably 700° C., more preferably 730° C., and still more preferably 740° C.

In this heating straightening step, a heating means such as ohmic heating and induction heating can be used, but ohmic heating is preferably applied so that an effect of facilitating aligning of the axis of easy magnetization of crystal grains in the hot-rolled material in a certain direction is obtained and it has an advantage of being able to rapidly (for example, within 1 minute) and uniformly heat the material to a target temperature. In addition, the tension during the heating straightening step is preferably adjusted to 1 to 4 MPa in order to obtain a desired residual strain more reliably. In addition, it is preferable to adjust the elongation to 3 to 10% with respect to the full length before the heating straightening step.

In the present embodiment, regarding the bar that has been subjected to the heating straightening step, centerless polishing may be performed using, for example, a centerless grinder. Thereby, the unfinished surface on the bar surface layer can be removed, and the roundness and tolerance accuracy of the shape can be further improved. In the present invention, since the straightness of the bar is improved according to the heating straightening step, centerless polishing can be performed without cutting a long bar having a length of 1,000 mm or more.

Next, an Fe—Co-based alloy bar of the present invention, which can be obtained by the above manufacturing method of the present invention, will be described. The Fe—Co-based alloy bar of the present invention contains 20% or more of crystal grains having a grain orientation spread (GOS) value of 0.5° or more in terms of an area ratio. This GOS value can be measured by a conventionally known "electron backscatter diffraction (SEM-EBSD) method," and can be derived by calculating the orientation difference of points (pixels) constituting crystal grains. The crystal orientation difference obtained from the GOS value is an index indicating the strain imparted to the alloy by processing, and when the bar contains 20% or more of crystal grains having a GOS value of 0.5° or more in terms of an area ratio, the driving force for crystal grain growth is introduced into the bar, and there is an advantage of favorable magnetic properties being obtained. When the proportion of a region in which the GOS value is 0.5° or more is less than 20%, favorable magnetic properties cannot be obtained because the bar has an insufficient driving force for crystal grain growth. In the crystal grains having a GOS value of 0.5° or more, the area ratio is preferably 40% or more, the area ratio is more preferably 50% or more, the area ratio is still more preferably 60% or more, the area ratio is yet more preferably 70% or more, the area ratio is particularly preferably 80% or more, and the area ratio is most preferably 90% or more. Here, the crystal grains having a GOS value of 0.5° or more can be observed in the cross section in the direction perpendicular to the axis of the bar. In addition, the cross section in which the area ratio is observed includes a cross section in the direction perpendicular to the axis and a cross section in the axial direction, but the area ratio is preferably 20% or more (more preferably 40% or more, still more preferably 50% or more, yet more preferably 60% or more, particularly preferably 70% or more, and most preferably 80% or more) in both cases of observing the cross section in the direction perpendicular to the axis and the cross section in the axial direction of the bar. This is because the effect of strain due to rolling traces generated in the base material during the hot rolling step is easily observed in the cross section in the axial direction of the bar, and the area ratio observed in the cross section in the axial direction may be smaller than the area ratio observed in the cross section in the direction perpendicular to the axis. Therefore, even in the cross section in the axial direction in which the area ratio tends to be small, the effect of the present invention can be more reliably achieved if the numerical value of the area ratio is satisfied.

In addition, the average crystal grain size number of the Fe—Co-based alloy bar of the present invention is preferably 6.0 or more and 9.5 or less. Thereby, strong magnetic properties after magnetic annealing are easily exhibited, and the processability tends to be further improved. The lower limit of the average crystal grain size number is more preferably 6.5 or more, and the upper limit of the average crystal grain size number is more preferably 9.0 or less. The upper limit of the average crystal grain size number is still more preferably 8.5 or less, and still more preferably 8.0 or less. Here, the average crystal grain size number can be measured based on JIS G 0551. Thus, it can be measured in the cross section in the direction perpendicular to the axis or the cross section in the axial direction of the bar.

EXAMPLES

Example 1

An Fe—Co-based alloy steel ingot having a composition shown in Table 1 was formed into an ingot and then hot-rolled to prepare a Φ11.5 mm hot-rolled bar.

<Sample No. 1 and Sample No. 2>

The above hot-rolled bars were subjected to a solution treatment in which the bar was heated at 850° C. and then rapidly cooled, and then subjected to a heating straightening step in which the hot-rolled bar was pulled in the length direction under a condition of a tension of 2.7 MPa while heating so that the temperature of the bar was 750° C. to produce Fe—Co-based alloy bars of Sample Nos. 1 and 2, which are examples of the present invention.

<Sample No. 3>

The above hot-rolled bar was not subjected to a solution treatment, but a heating straightening step was performed to produce an Fe—Co-based alloy bar of Sample No. 3 which is an example of the present invention. The conditions for the heating straightening step were the same as those in Sample No. 1.

<Sample No. 4>

The above hot-rolled bar was subjected to a solution treatment under the same conditions as in Sample No. 1, the heating straightening step was not performed, the other steps were performed in the same manner as in the example of the present invention, and thereby an Fe—Co-based alloy bar of Sample No. 4, which is a comparative example, was produced.

TABLE 1

(mass %)

| Sample No. | C | Si | Mn | Co | V | Remainder |
|---|---|---|---|---|---|---|
| 1, 4 | 0.01 | 0.03 | 0.13 | 49.01 | 1.98 | Fe and unavoidable impurities |
| 2 | 0.01 | 0.04 | 0.13 | 49.01 | 1.97 | Fe and unavoidable impurities |
| 3 | 0.01 | 0.04 | 0.13 | 49.07 | 1.97 | Fe and unavoidable impurities |

Next, the average crystal grain size, the GOS value and the DC magnetic properties of the samples of examples of the present invention and the comparative example were confirmed. For the average crystal grain size, in the horizontal cross section (cross section in the direction perpendicular to the axis), using an optical microscope (commercially available from Olympus), 10 fields of view of 500 μm×350 μm were observed, and the particle size number was determined on the crystal grain size standard drawing plate I according to JIS G 0551. The GOS value was determined using a field emission scanning electron microscope (commercially available from ZEISS) and an EBSD measurement/analysis system orientation-imaging-micrograph (OIM) (commercially available from TSL). For Sample No. 1 and Sample No. 4, the horizontal cross section (cross section in the direction perpendicular to the axis) was observed, and for Sample No. 2 and Sample No. 3, the vertical cross section (cross section in the axial direction that passes through the central axis) was also observed in addition to the above horizontal cross section of the sample. The measurement field of view was 100 μm×100 μm, and the step distance between adjacent pixels was 0.2 μm. In addition, observation was performed under the condition in which a boundary having an orientation difference between adjacent pixels of 5° or more was discriminated from a crystal grain boundary, and from the obtained GOS value map, an area rate with respect to the entire observation field occupied by crystal grains having a GOS value of 0.5° or more was obtained. Regarding the DC magnetic properties, a sample was collected from the obtained bar, and magnetic annealing was then performed at 850° C.×3 hours, and the maximum magnetic permeability and a coercive force were measured using a DC magnetization specific test device. Table 2 shows the observation results.

TABLE 2

| Sample No. | Average crystal grain size number | Area ratio (%) of crystal grains having a GOS value of 0.5° or more: Vertical cross section | Horizontal cross section | Maximum magnetic permeability | Coercive force (A/m) | Note |
|---|---|---|---|---|---|---|
| 1 | 7.0 | 94 | — | 14800 | 41 | Example of present invention |
| 2 | 8.0 | 85 | 87 | 19600 | 39 | Example of present invention |
| 3 | 9.0 | 62.5 | 40.2 | 18600 | 42 | Example of present invention |
| 4 | 9.0 | 8.6 | — | 8400 | 68 | Comparative example |

Based on Table 2, Sample No. 1 and Sample No. 2, which are examples of the present invention, had a smaller average crystal grain size number than the comparative example (had a larger crystal grain size than the comparative example), and Sample No. 3 on which no solution treatment was performed had the same average crystal grain size number as the comparative example. Regarding the area ratio of crystal grains having a GOS value of 0.5° or more, it was confirmed that the example of the present invention had a much larger value of the area ratio than the comparative example. Regarding the magnetic properties, Samples No. 1 to No. 3 had higher magnetic permeability and a lower coercive force than the comparative example. Accordingly, it was confirmed that all of the examples of the present invention had better magnetic properties than the comparative example.

Example 2

An Fe—Co-based alloy steel ingot having a composition shown in Table 3 was formed into an ingot and then hot-rolled to prepare a Φ11.5 mm hot-rolled bar. Then, no solution treatment was performed, and a heating straightening step was performed under the condition of a tension of 2.7 MPa while heating so that the temperature of the bar was the temperature shown in Table 4 to produce Fe—Co-based alloy bars of Sample Nos. 5 to 7. Based on the results of Table 4, it was confirmed that all Sample Nos. 5 to 7 on which the heating straightening step was performed at a bar temperature of 500 to 900° C. had a low coercive force and had excellent magnetic properties.

TABLE 3

(mass %)

| Sample No. | C | Si | Mn | Co | V | Remainder |
|---|---|---|---|---|---|---|
| 5, 6, 7 | 0.01 | 0.03 | 0.13 | 49.20 | 1.98 | Fe and unavoidable impurities |

TABLE 4

| Sample No. | Bar temperature (° C.) | Coercive force [A/m] |
|---|---|---|
| 5 | 739 | 39 |
| 6 | 846 | 41 |
| 7 | 863 | 38 |

The invention claimed is:

1. A method for manufacturing an Fe—Co-based alloy bar, comprising a heating straightening step in which tensile stress is imparted by pulling to a hot-rolled material of an Fe—Co-based alloy while heating the hot-rolled material to a temperature of 500 to 900° C., wherein the Fe—Co-based alloy contains 95% or more of Fe+Co in mass %.

2. The method for manufacturing an Fe—Co-based alloy bar according to claim 1, wherein in the heating straightening step, tensile stress is imparted by pulling to the hot-rolled material of the Fe—Co-based alloy while heating the hot-rolled material to the temperature of 500 to 850° C.

3. The method for manufacturing an Fe—Co-based alloy bar according to claim 1, wherein ohmic heating is used as a heating means in the heating straightening step.

4. The method for manufacturing an Fe—Co-based alloy bar according to claim 1, wherein a solution treatment is performed before the heating straightening step.

5. The method for manufacturing an Fe—Co-based alloy bar according to claim 2, wherein ohmic heating is used as a heating means in the heating straightening step.

6. The method for manufacturing an Fe—Co-based alloy bar according to claim 2, wherein a solution treatment is performed before the heating straightening step.

7. The method for manufacturing an Fe—Co-based alloy bar according to claim 3, wherein a solution treatment is performed before the heating straightening step.

8. The method for manufacturing an Fe—Co-based alloy bar according to claim 5, wherein a solution treatment is performed before the heating straightening step.

* * * * *